US006139405A

United States Patent [19]

Becker

[11] Patent Number: 6,139,405

[45] Date of Patent: Oct. 31, 2000

[54] METHOD OF MAKING A MOTOR-VEHICLE BRAKE-DISK ASSEMBLY

[75] Inventor: Manfred G. Becker, Novi, Mich.

[73] Assignee: Ernst Thielenhaus GmbH & Co. KG, Wuppertal, Germany

[21] Appl. No.: 09/304,875

[22] Filed: May 4, 1999

Related U.S. Application Data

[63] Continuation-in-part of application No. 09/233,595, Jan. 19, 1999.

[51] Int. Cl.[7] ..... B24B 7/17

[52] U.S. Cl. ..... 451/63; 451/51; 451/6; 451/268

[58] Field of Search ..... 451/6, 51, 63, 451/268, 259, 413, 49; 29/894, 86, 894.362, 898.07

[56] References Cited

U.S. PATENT DOCUMENTS 4,361,988 12/1982 Gramlich ..... 451/63
4,766,702 8/1988 Kinner ..... 451/63
4,959,902 10/1990 Hamilton ..... 29/898.07
5,430,926 7/1995 Hartford ..... 29/434
5,807,162 9/1998 Dana ..... 451/413

*Primary Examiner*—David A. Scherbel
*Assistant Examiner*—G. Nguyen
*Attorney, Agent, or Firm*—Herbert Dubno; Andrew Wilford

[57] ABSTRACT

A brake disk is machined the by first fitting to a wheel hub centered on a hub axis and having a radially projecting flange a wheel bearing having an outer bearing race formed with an axially directed mounting surface for attachment to a motor vehicle. Then the mounting surface of the outer bearing race is clamped axially to a stationary workpiece carrier so as to mount the wheel hub on the workpiece carrier. A brake disk having a pair of opposite faces extending substantially perpendicular to the axis is then secured to the flange and the wheel hub and the brake disk are rotated about the axis. Then the faces of the rotating brake disk are engaged with machining tools to surface machine the faces.

9 Claims, 5 Drawing Sheets

METHOD OF MAKING A MOTOR-VEHICLE BRAKE-DISK ASSEMBLY

CROSS REFERENCE TO RELATED APPLICATION

This application is a continuation-in-part of copending application Ser. No. 09/233,595 filed Jan. 19, 1999.

FIELD OF THE INVENTION

The present invention relates to a method of truing the faces of a motor-vehicle brake disk. More particularly this invention concerns the surface grinding of the parts of a motor-vehicle wheel assembly so that the brake-disk faces are planar and perpendicular to the axis of the wheel hub within very narrow tolerances.

BACKGROUND OF THE INVENTION

The machining of flange faces of a wheel hub and especially the surface grinding thereof is important since those faces are attachment surfaces for the brake disks of wheel hubs which are provided with disk brakes. When the flange faces are not both planar to within a narrow tolerance and not exactly perpendicular to the axis of rotation of the wheel hub, the brake disk attached to the flange and rotating with the wheel hub has a certain degree of wobble and shows angular position-dependent offset movements in the axial direction that can be described as knocking or flapping. Indeed, even very slight angle-dependent offset movements or wobble can translate into pulsations which are transmitted to the brake pedal and can be noticeable during the braking operation.

Such machining defects at the flange face of the wheel hub become all the more noticeable and significant as the brake disk attached thereto is of larger diameter. The problem is, therefore, usually more noticeable on small transport-type vehicles or utility vehicles like pick-up trucks, heavier trucks and similar utility vehicles than it is for passenger-type vehicles like automobiles.

In conventional fabrication methods the faces of the wheel hub are finish-machined before the wheel bearings are mounted on the hub. Following mounting of the hub and the wheel bearing in a vehicle, as a unit, a problem with wobble can be discovered upon rotation of the wheel hub. Depending upon the particular vehicle, it is not uncommon to have a rotation angle-dependent offset movement in the axial direction which is of the order of 40 $\mu$m to 60 $\mu$m. That magnitude of offset or axial throw will give rise to detrimental wobble. With increasing diameter of the brake disk, the wobble is more severe. The axially offset movement, which is also rotation-angle dependent of the brake disk can amount to up to 100 $\mu$m and magnitudes of this nature give rise to significant vibrations at the brake pedal when the brake is actuated.

OBJECT OF THE INVENTION

It is therefore an object of the present invention to provide an improved method of machining a wheel assembly so that the faces of a motor-vehicle brake disk are perfectly planar and a perpendicular to the wheel axis.

SUMMARY OF THE INVENTION

A planar flange surface of a flange of a wheel hub is machined by first fitting a wheel hub having a flange with a surface to be ground with a wheel bearing having an outer bearing race formed with a mounting surface for attachment to a motor vehicle. Then the mounting surface of the outer bearing race is clamped to a stationary workpiece carrier so as to mount the wheel hub on the workpiece carrier. The wheel hub and the flange are then rotated about a hub axis and the surface of the flange is engaged by a machining tool so as to surface machine the flange. Then a previously trued brake disk can be mounted to this surface.

A brake disk is machined according to another feature of the invention by first fitting to a wheel hub centered on a hub axis and having a radially projecting flange a wheel bearing having an outer bearing race formed with an axially directed mounting surface for attachment to a motor vehicle. Then the mounting surface of the outer bearing race is clamped axially to a stationary workpiece carrier so as to mount the wheel hub on the workpiece carrier. A brake disk having a pair of opposite faces extending substantially perpendicular to the axis is then secured to the flange and the wheel hub and the brake disk are rotated about the axis. Then the faces of the rotating brake disk are engaged with machining tools to surface machine the faces.

With this system the brake-disk faces are therefore perpendicular to the axis of the bearing and wheel hub they will be mounted on in the motor vehicle the brake disk will eventually be incorporated in. This avoids the prior-art problem where some irregularity in the wheel hub or bearing causes a brake disk, whose faces are perfectly planar and parallel, to wobble and create pulsations during braking.

The brake disk is secured in accordance with the invention to the flange by pressing a retaining disk against the brake disk and bolting the retaining disk through the brake disk to the hub. This retaining disk is pressed against the brake disk with a force generally equal to the force with which the brake disk is pressed against the hub when the hub is mounted on a motor vehicle. In the simplest embodiment the retaining disk is bolted through the brake disk to the hub with screws torqued down the same as the screws that normally hold the wheel on the vehicle. Thus any distortions introduced by such bolting will be taken into account when the disk is machined.

The disk faces are machined planar according to the invention and the tools are rotating grinding wheels rotated about wheel axes parallel to the hub axis.

In addition in accordance with the invention the faces of the brake disk are sensed to detect angle-dependent axial displacements of the sensor representing deviations from planarity of the surface of the flange. The machining of the faces is terminated on measurement of the axial displacements falling within a permissible tolerance range. Thus once the desired planarity is attained, machining is automatically stopped.

The workpiece carrier according to the invention surrounds a driven spindle of a machine tool which according to the invention is flexibly connected to the hub. Alternately the go hub and brake disk are rotated by engagement from above by a rotary drive. This latter method is particularly useful when a turntable is used that has a pair of work stations each provided with a respective workpiece carrier. A finish machined brake disk with its hub and bearing are unloaded from one of the work stations and an unmachined brake disk with its hub and bearing are fitted to the one work station while a brake disk is being machined in the other work station. Both faces of the brake disk are machined simultaneously. In addition during machining the disk is pressed against the hub and bearing.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
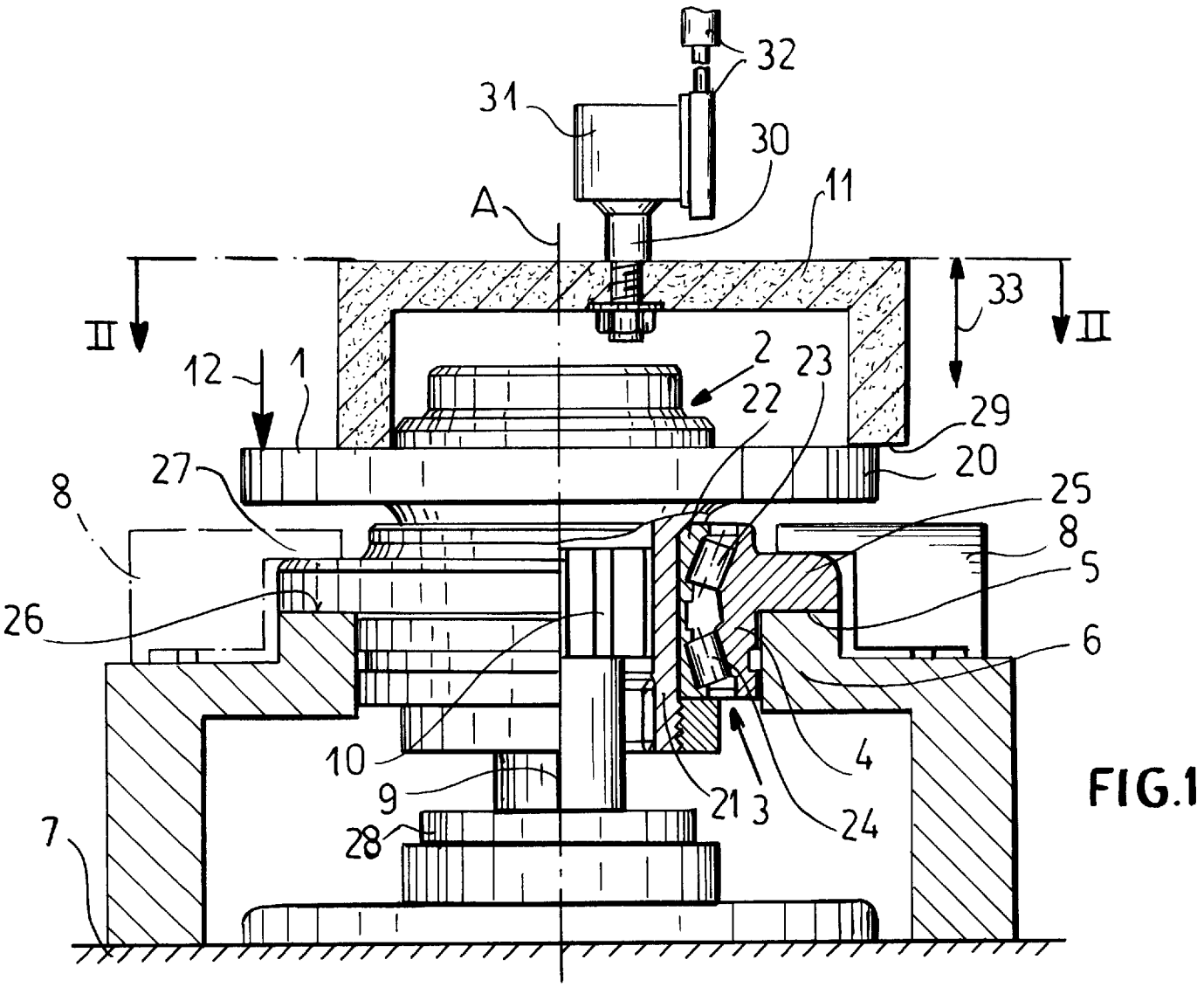
FIG. 1 is a partly diagrammatic vertical section through a grinding system for carrying out the method of this invention.
Figure 2:
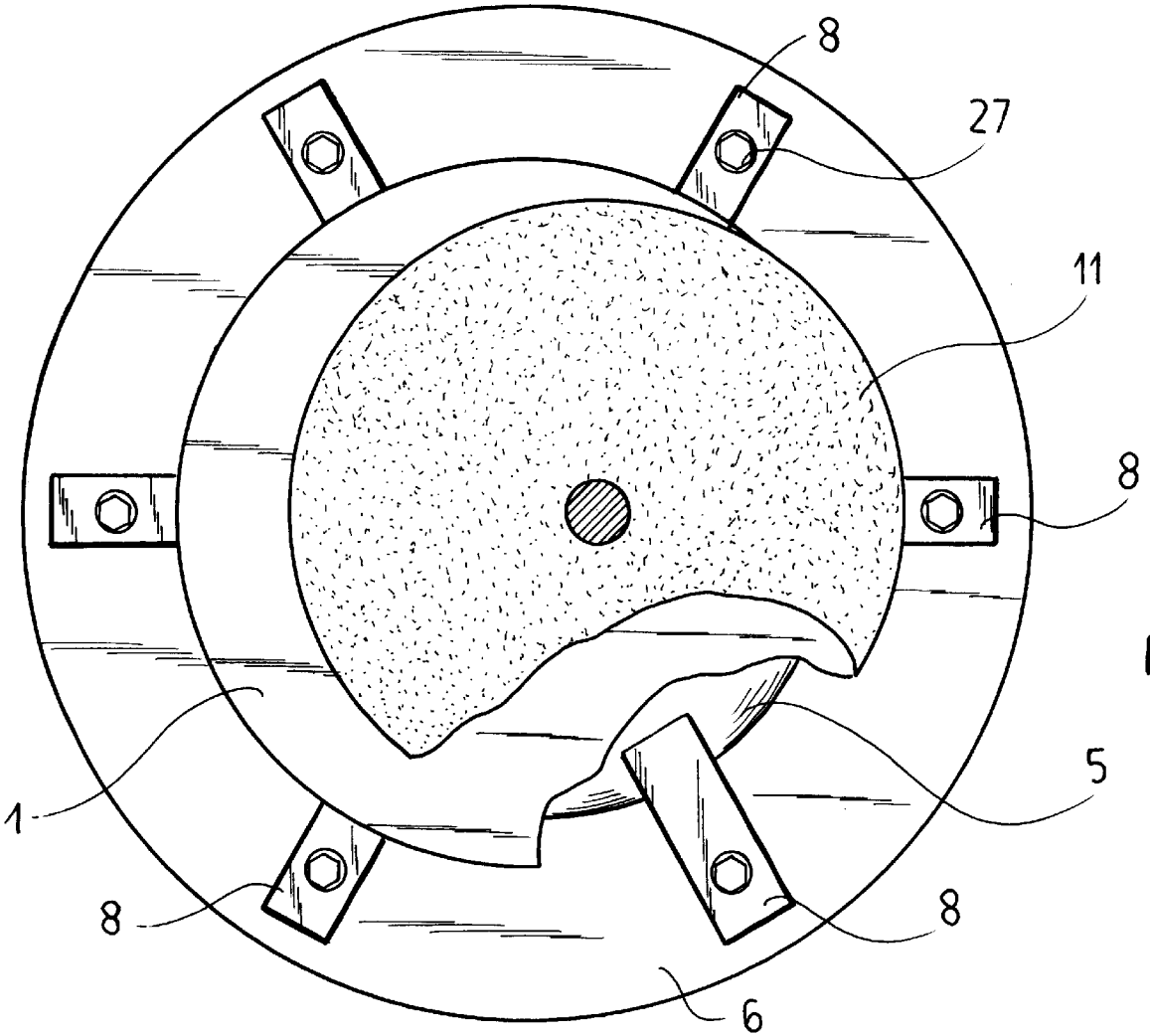
FIG. 2 is a horizontal section taken along line II—II A of FIG. 1.

FIGS. 1 and 2 show a system for surface grinding a surface 1 of a flange 20 of a motor-vehicle wheel hub 2 having a sleeve 21 all centered on an axis A. The flange surface 1 is intended to form a mounting surface for a brake disk of a disk brake system for the wheels of the motor vehicle on which the hub 2 is to be mounted. Before the surface grinding, the hub 2 is fitted with a wheel bearing 3 which comprises an inner race 22 fitted to the sleeve 21, rollers 23 and 24, and an outer race 4 having a radially projecting flange 25 formed with a mounting surface 5. The surface 5 serves for mounting the wheel assembly formed by the bearing 3 and the hub 2 on the motor vehicle.

The assembly 2, 3 is clamped to a fixed surface 26 of a workpiece carrier 6 which is nonrotatable and is mounted on a machine bed 7. Clamps 8 arranged in a star pattern (see FIG. 2) may each comprise a block which is traversed by a respective screw 27 threaded into the workpiece carrier 6. The clamping blocks 8 have projections overhanging the flange 25 and pressing the mounting surface 5 of the outer bearing race 4 against the surface 26 so that the rotation axis A defined by the bearing 3 is perfectly perpendicular to the surface 26. The wheel hub 2 is driven by a spindle 9 of the machining system which has a drive 28 and is connected by a flexible adapter element 10 to the hub 2.

The machining tool is a grinding wheel 11 which is cup-shaped and has a planar and annular rim 29 which can be pressed axially against the surface 1. The grinding disk 11 is rotated by a spindle 30 of a motor 31 mounted on a hydraulic or pneumatic piston-and-cylinder actuator 32 which is capable of lifting the disk 11 away from the hub 2 to allow the hub 2 to be removed after loosening of the clamps 8. The actuator 32 in addition exerts axial pressure on the disk 11 that serves to press its rim 29 against the surface 1 of the flange 20. Such axial displaceability of the grinding wheel 11 is represented by double-headed arrow 33.

During the grinding process the flange surface 1 of the rotating wheel hub 2 is monitored by a sensor illustrated schematically at 12 which measures the axial throw of the surface 1 as a function of the angle through which the flange 20 has been rotated. This axial throw represents the planarity of the surface 1 and grinding is halted when the measured value from the sensor 12 lies within a certain tolerance range. The axial throw upon completion of the grinding operation should be less than 8 $\mu$m and preferably as little as about 2 $\mu$m which can readily be achieved with the instant invention. Normally an average of 4 $\mu$m is achieved.

Once the surface 1 is ground so that it is perfectly planar and perpendicular to the axis A, a brake disk whose opposite faces are perfectly planar and parallel to each other is bolted to it. Since the surface 1 is oriented perfectly with respect to the axis A, the faces of the brake disk will also inherently be perpendicular to this axis A.

Figure 3:
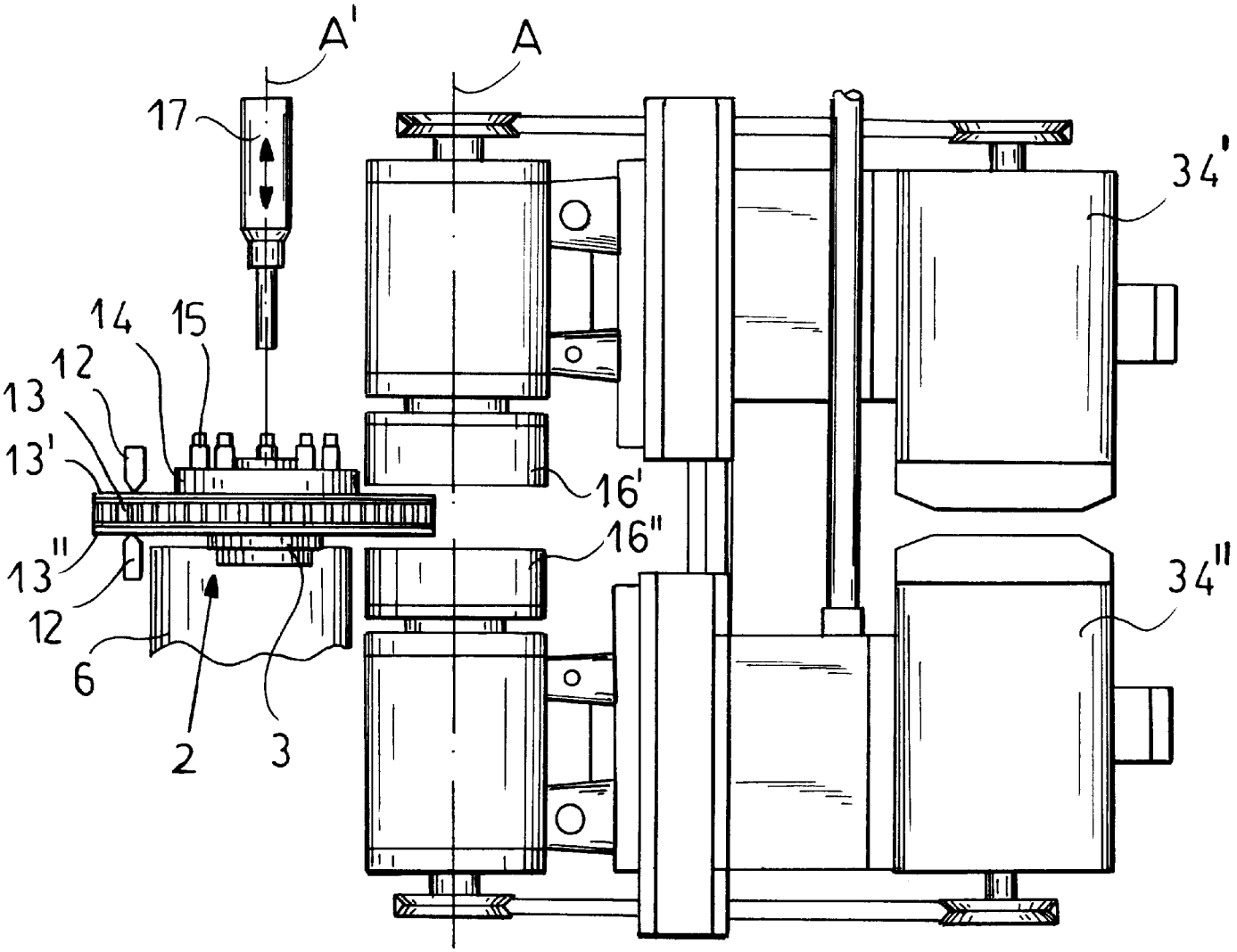
FIG. 3 is a side view of another apparatus for carrying out the method of this invention.

FIG. 3 shows an arrangement which serves to machine the parallel planar faces 13' and 13" of a brake disk 13 secured to the hub 2 mounted as in FIGS. 1 and 2 via its bearing 3 on a carrier 6. The disk 13 is held in place on the machined face 1 by a clamping disk 14 and screws 15 threaded into the hub 2 with the same torque as is used as when a wheel is bolted through the disk 13 to the hub 2 in a standard installation. Thus the disk 13 is in the same exact position on the hub 2 it would assume in use. Here the drive system 9, 10, 28 of FIGS. 1 and 2 is replaced by an overhead drive 17. During machining and rotation an axial preload is used to eliminate any axial play between the bearing 3 and the hub 2.

The two faces 13' and 13" are simultaneously machined by identical grinding disks 16' and 16" rotated about an axis A' parallel to the wheel axis A, duplicating the load put on the brake disk by the shoes during braking. Respective drives 34' and 34" rotate these disks 16' and 16" to remove material from them until they are planar and perpendicular to the axis A. As in FIGS. 1 and 2, sensors 12 monitor the planarity of the faces 13' and 13" and retract the wheels 16' and 16" when the planarity is in the desired range.

Figure 4:
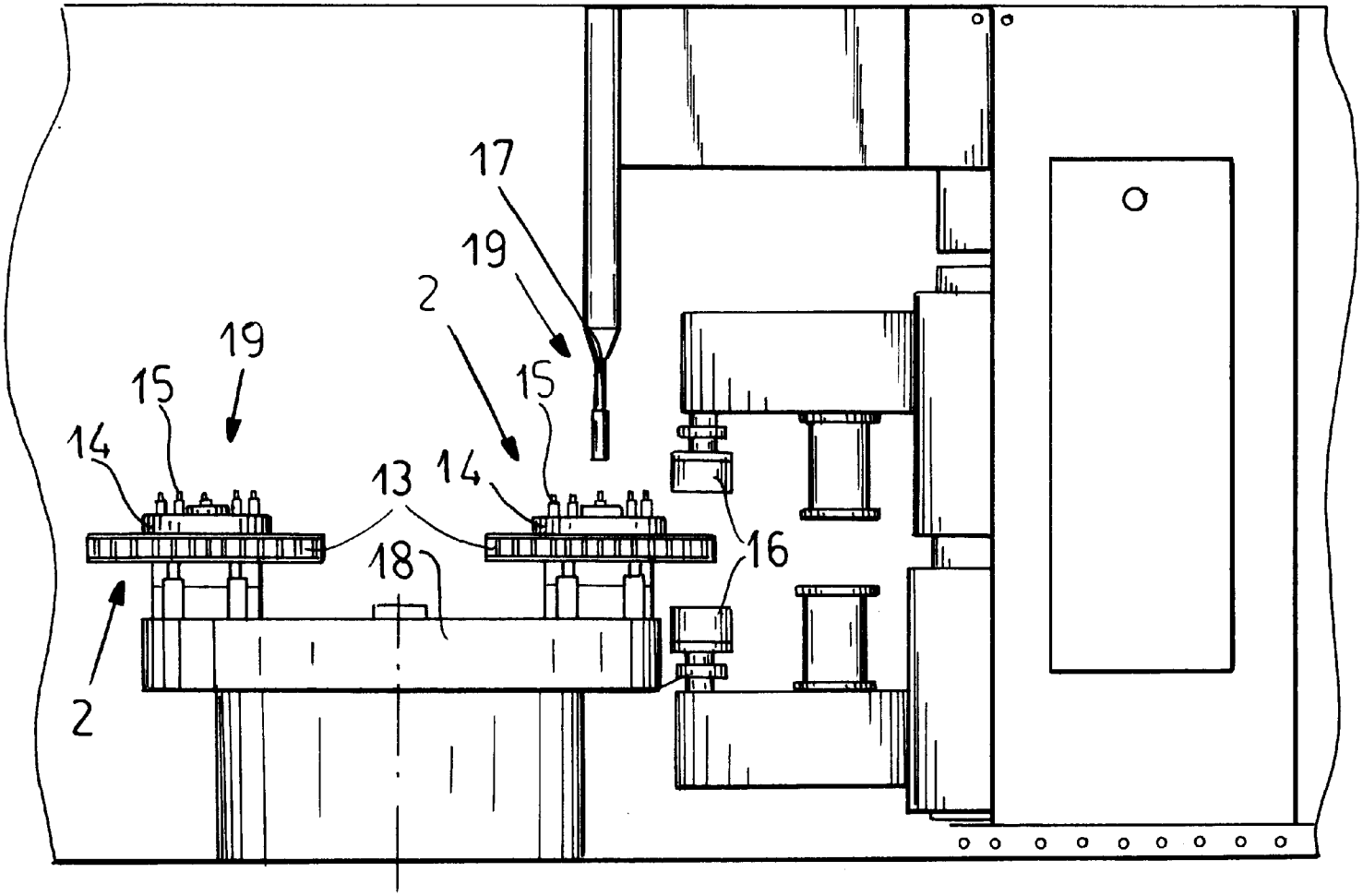
FIG. 4 is a side view of yet another such apparatus.

FIG. 4 shows a variation on the system of FIG. 3 where a turntable 18 forms at least two work stations 19, each holding a respective hub 2, bearing 3, and disk 13. Each time the turntable 18 is indexed angularly, it brings one of the work stations 19 into alignment with the drive 17 and disks 16 so the respective grinding tools 16' and 16" can machine its faces 13' and 13". While one disk 13 is being machined, the machined disk 13 can be unloaded with its hub 2 and bearing 3 from the other station 19 and an unmachined disk 13 with its hub 2 and bearing 3 can be set in place. It is even possible for only the hub 2 and bearing to be loaded into a work station, then its face 1 can be machined, then the disk 13 is clamped in place, and then the disk faces 13' and 13" are machined.

Figure 5:
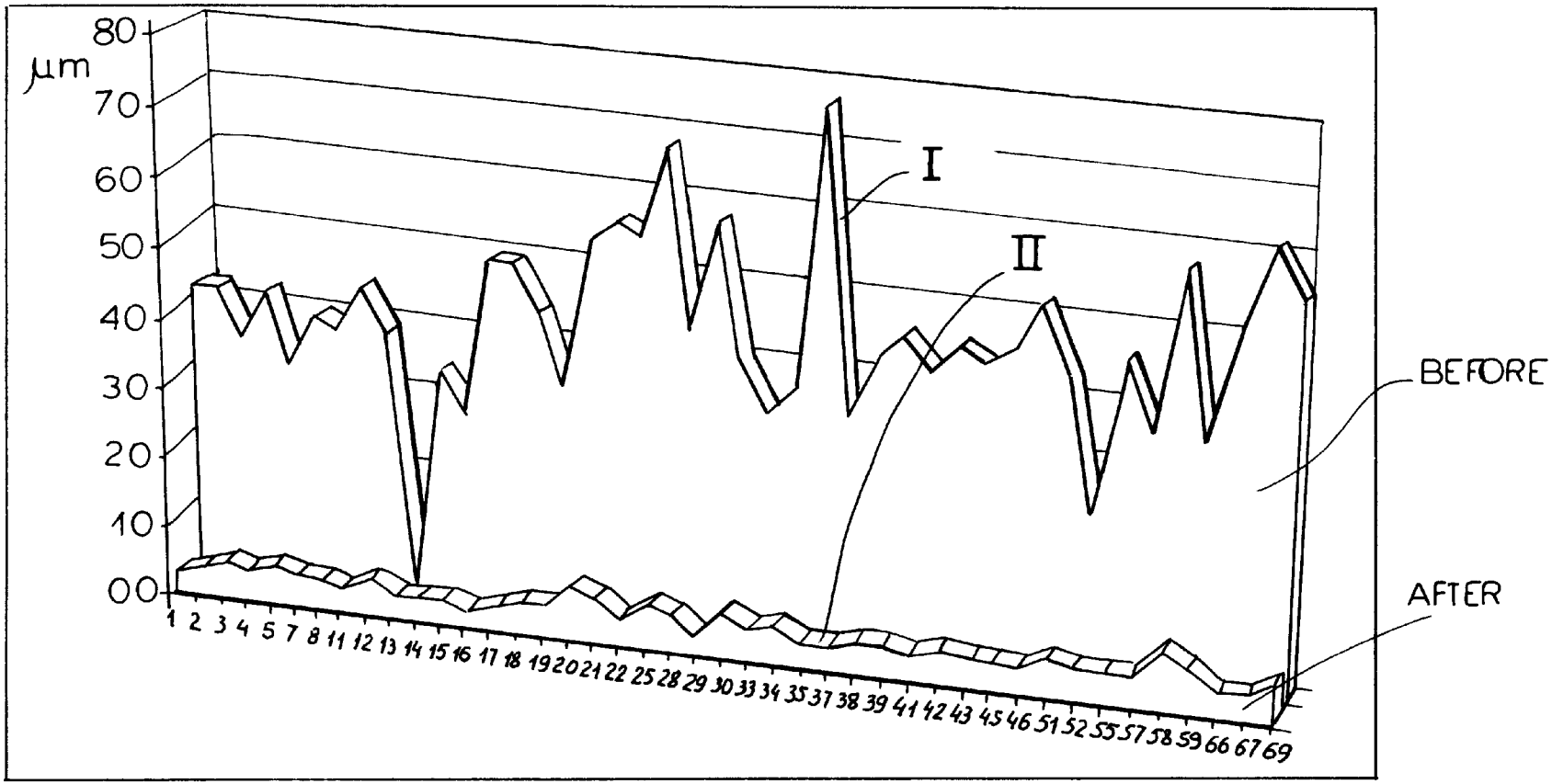
FIG. 5 is a graph comparing the instant invention with the prior art.

FIG. 5 shows a graph representing on the abscissa 69 different workpieces and on the ordinate the variation in planarity in microns for them. Line I shows the variation in a standard prior-art machining operation while line II shows the variation with the system of this invention. More specifically, when the disks are machined separate from their hubs the variation from planarity lies generally between 24 $\mu$m and 74 $\mu$m, averaging 51 $\mu$m. With the system of this invention the variation averages about 4 $\mu$m.

I claim:

1. A method of machining a brake disk assembly having a brake disk, a wheel hub, and a wheel bearing the method comprising the steps of:

fitting to the wheel hub centered on a hub axis and having a sleeve, a flange protecting radially from the sleeve, and the wheel bearing having an inner bearing race fitted to the sleeve and an outer bearing race formed with an axially directed mounting surface for attachment to a motor vehicle;

clamping the mounting surface of the outer bearing race axially to an annular stationary workpiece carrier and thereby mounting the wheel hub on the workpiece carrier;

securing to the flange the brake disk having a pair of opposite faces extending substantially perpendicular to the axis by pressing a retaining disk against the brake disk with a force generally equal to the force with which the brake disk is pressed against the hub when the hub is mounted in a motor vehicle and bolting the retaining disk through the brake disk to the hub;

rotating the wheel hub and the brake disk about the axis; and engaging the faces of the rotating brake disk with machining tools and thereby surface machining the faces.

2. The method defined in claim 1 wherein the disk faces are machined planar.

3. The method defined in claim 1 wherein the tools are rotating grinding wheels rotated about wheel axes parallel to the hub axis.

4. The method defined in claim 1, further comprising the steps of sensing the faces of the brake disk and thereby detecting angle-dependent axial displacements of the brake-disk faces representing deviations from planarity of the surface of the flange; and terminating the machining of the faces on measurement of the axial displacements falling within a permissible tolerance range.

5. The method defined in claim 1 wherein the workpiece carrier surrounds a driven spindle of a machine tool, further comprising the step of flexibly connecting the spindle to the hub.

6. The method defined in claim 1 wherein the hub and brake disk are rotated by engagement from above by a rotary drive.

7. The method defined in claim 1 wherein a turntable has a pair of work stations each provided with a respective workpiece carrier, the method further comprising the step of unloading a finish machined brake disk with its hub and bearing from one of the work stations and fitting an unmachined brake disk with its hub and bearing to the one work station while machining a brake disk in the other work station.

8. The method defined in claim 1, further comprising the step of axially pressing the disk against the hub and bearing during machining of the faces.

9. The method defined in claim 1, wherein the mounting surface is clamped to the carrier by a plurality of clamps.

* * * * *

UNITED STATES PATENT AND TRADEMARK OFFICE

CERTIFICATE OF CORRECTION

PATENT NO. : 6,139,405
APPLICATION NO. : 09/304875
DATED : October 31, 2000
INVENTOR(S) : Manfred G. Becker It is certified that error appears in the above-identified patent and that said Letters Patent is hereby corrected as shown below:

In column 4, Claim 1, line 59, "protecting" should be changed to --projecting--.

Signed and Sealed this

Twenty-second Day of December, 2009

David J. Kappos

David J. Kappos
*Director of the United States Patent and Trademark Office*